US007393086B2

(12) United States Patent
Otte et al.

(10) Patent No.: US 7,393,086 B2
(45) Date of Patent: Jul. 1, 2008

(54) METHOD AND DEVICE FOR CHANGING THE TRAJECTORY OF INK DROPLETS

(75) Inventors: Frank Otte, Würzburg (DE); Klaus Pechtl, Stadt-Schwarzach (DE); Georg Schmidt, Gerbrunn (DE); Roland Wernsdorfer, Würzburg (DE)

(73) Assignee: KBA - Metronic AG, Veitshochheim (DE)

( * ) Notice: Subject to any disclaimer, the term of this patent is extended or adjusted under 35 U.S.C. 154(b) by 0 days.

(21) Appl. No.: 11/550,870

(22) Filed: Oct. 19, 2006

(65) Prior Publication Data

US 2007/0081051 A1 Apr. 12, 2007

(30) Foreign Application Priority Data

Dec. 9, 2005 (DE) ..... 10 2005 059 328

(51) Int. Cl.
*B41J 2/09* (2006.01)

(52) U.S. Cl. ..... 347/77

(58) Field of Classification Search ..... 347/77, 347/76, 78, 79, 80, 82, 73
See application file for complete search history.

(56) References Cited

U.S. PATENT DOCUMENTS 4,068,240 A 1/1978 Fan et al.
4,290,073 A 9/1981 Jinnai et al.
4,346,387 A 8/1982 Hertz
4,555,713 A 11/1985 Ishima
4,636,808 A 1/1987 Herron
2004/0026479 A1 2/2004 Farnworth
2005/0248618 A1 11/2005 Pinard et al.

FOREIGN PATENT DOCUMENTS

DE 3414948 A1 10/1984
JP 355133972 A * 10/1980
WO WO 81/03149 11/1981

OTHER PUBLICATIONS

German Search Report, Apr. 2, 2007.
European Search Report, Apr. 2, 2007.

* cited by examiner

*Primary Examiner*—K. Feggins
(74) *Attorney, Agent, or Firm*—Chadbourne & Parke, LLP

(57) ABSTRACT

The invention relates to a method for changing the trajectory of ink droplets generated by and emitted from a print head which operates in a continuous manner, the ink droplets being electrostatically charged and deflected in a plane out of an original trajectory by at least one electrical field in a first deflecting device, the ink droplets being deflected in the same plane by at least one electrical field in a second deflecting device. The invention further relates to an inkjet printing device for emitting, in particular in a continuous manner, electrostatically charged ink droplets in an original trajectory by means of a first deflecting device for deflecting the charged ink droplets in a plane out of the original trajectory, at least one second deflecting device being provided by which the ink droplets may be deflected in the same plane.

9 Claims, 3 Drawing Sheets

METHOD AND DEVICE FOR CHANGING THE TRAJECTORY OF INK DROPLETS

FIELD

The invention relates to a method for changing the trajectory of ink droplets generated by and emitted from a print head which operates in a continuous manner. The ink droplets are electrostatically charged, and are deflected in a plane out of an original trajectory by at least one electrical field in a first deflecting device.

The invention further relates to an inkjet printing device for emitting, in a continuous manner, electrostatically charged ink droplets in an original trajectory by means of a first deflecting device for deflecting the charged ink droplets in a plane out of the original trajectory.

BACKGROUND

Continuously operating inkjet printing devices have been in commercial use for many years for labeling a large variety of products. In general, a technical distinction may be made between two variants having the same principle of operation, namely, the single-jet continuous printer and the multijet continuous printer.

The common principle of operation lies in the fact that an ink to be printed is conveyed at positive pressure via pumps from a supply container into a pressure chamber having a nozzle, in the actual print head. The nozzle may have an opening diameter in the range of 30 pm to 200 pm, for example. The ink jet is emitted from the nozzle, for example, initially as a continuous ink jet. This, however, is impractical for labeling because the characters produced by this method are composed of single dots, i.e., individual ink droplets. In order to disperse the ink jet into individual homogeneous ink droplets, a modulation element is provided at the pressure chamber which generates pressure fluctuations in the exiting ink jet, so that after being emitted from the nozzle the ink jet is dispersed into individual homogeneous ink droplets. Shortly before the ink droplets separate they are each provided with an individual electrical charge, the magnitude of the charge depending on the desired position of impingement on the product to be labeled.

It is also possible to use pulsed print heads which instantaneously generate individual ink droplets which may be charged or which are already charged.

To ensure the charging, the ink has a low electrical conductivity. On their initially linear course on an original trajectory, the electrically charged ink droplets enter the electrostatic field of a plate capacitor and, depending on their individual charge, are more or less deflected from their linear motion, and after leaving the electrostatic field they continue at a specified angle, which is a function of the charge, with respect to their original trajectory.

By use of this principle, various impingement positions may be selected on a surface to be labeled with individual ink droplets, this occurring only in one direction of deflection. To mask individual droplets from the typeface, or if the droplets are not to be printed, the ink droplets acquire a certain charge or remain uncharged, so that after exiting the electrostatic field of the plate capacitor they strike a collection tube from which they are pumped back to the ink tank. In this manner the ink circulates in the system in a circuit, which has led to the term "continuous inkjet printer."

In the second referenced system, the multijet printer, there are multiple nozzles from which ink droplets are emitted simultaneously, wherein it is possible to individually charge the single droplets in each jet. In this case, however, only two charge states are produced by which the droplets either strike the respective collection tube or strike a designated fixed position on the surface of the product to be labeled.

By operating multiple nozzles simultaneously and positioning the nozzles in a line in this case, horizontal lines of a character may be controlled in parallel, not in series as in the single jet continuous printer, thereby significantly increasing the speed. A disadvantage of the multijet continuous printer system is that only a fixed number of addressable positions, corresponding to the number of available nozzles, may be addressed.

A disadvantage of the single jet continuous printer design is that the trajectories of the ink droplets emitted from the print head diffuse in a fan-like pattern, so that the font size of a character changes with the distance between the surface to be labeled and the print head, and legibility is impaired as the distance increases.

SUMMARY

The current invention may be used not only for continuously operated inkjet printing devices, but also for non-continuously operated inkjet printing devices.

The object of the invention is to improve the legibility of a label to be applied to the surface of a product by use of an inkjet printing device which operates in a continuous manner. A further object of the invention is to maintain a preset font size for the label, regardless of the distance of the print head from the product.

This object is achieved by a method in which the ink droplets are deflected in the same plane by at least one electrical field in at least one second deflecting device. The object is further achieved by an inkjet printing device in which at least one second deflecting device is provided, by which the ink droplets may be deflected in the same plane.

Using the method or the device, the divergence of the trajectories of the airborne ink droplets after a first deflection from the original trajectory by a first deflecting device may be influenced by a second deflecting device according to the invention. In principle, in this manner according to the invention it is still possible to change, i.e., to enlarge or preferably to reduce, the divergence of the trajectories of the ink droplets, i.e., relative to the trajectory, the deflection of each respective ink droplet from the original trajectory.

Thus, in a first preferred embodiment the ink droplets are deflected in at least one second deflecting device in a direction opposite to the direction of the first deflection in the first deflecting device, in such a way that the first deflection is compensated for at least partially, and preferably completely. Thus, in this embodiment the divergence of the ink droplets to be included in a printed image may be reduced, or preferably, even eliminated altogether.

In the preferred embodiment, it is possible to deflect the ink droplets by the at least one second deflecting device in such a way that the trajectories of all ink droplets run in parallel. Further, it is possible to deflect the trajectories of the ink droplets in such a way hat they run parallel to the original trajectory, provided that the second deflection occurs in the direction opposite that of the first deflection. The latter, however, is not absolutely necessary.

It is also possible to parallelize the trajectories where the trajectory of the ink droplets subsequent to a second deflecting device is at an angle with respect to the original trajectory.

Parallelization is particularly advantageous, since in this manner the trajectories of the ink droplets run essentially in parallel for all addressable impingement points, thereby achieving font sizes that are independent of the working distance which is the distance between the printed object and the print head.

In one preferred embodiment, the deflecting devices may be designed as electrode systems which have a first and at least one second deflecting device of different electrical polarities. In this manner it is possible to compensate for the deflections. In principle, an identical polarity may also be provided to achieve an even greater deflection, or for a multiple electrode system a mixed polarity may also be present within the second deflecting device in order to obtain simultaneous parallelization, if needed.

In one example design having a particularly simple structure, a deflecting device may include at least one plate capacitor, the trajectory/trajectories of the ink droplets passing through the field space of the at least one plate capacitor. A deflecting device may also include multiple plate capacitors consecutively positioned in the course of direction of the ink droplets, whereby the trajectories of the ink droplets pass through the respective field spaces of the plate capacitors.

BRIEF DESCRIPTION OF THE DRAWINGS

The prior art and two exemplary embodiments of the invention are illustrated in the figures.

DETAILED DESCRIPTION

Figure 1:
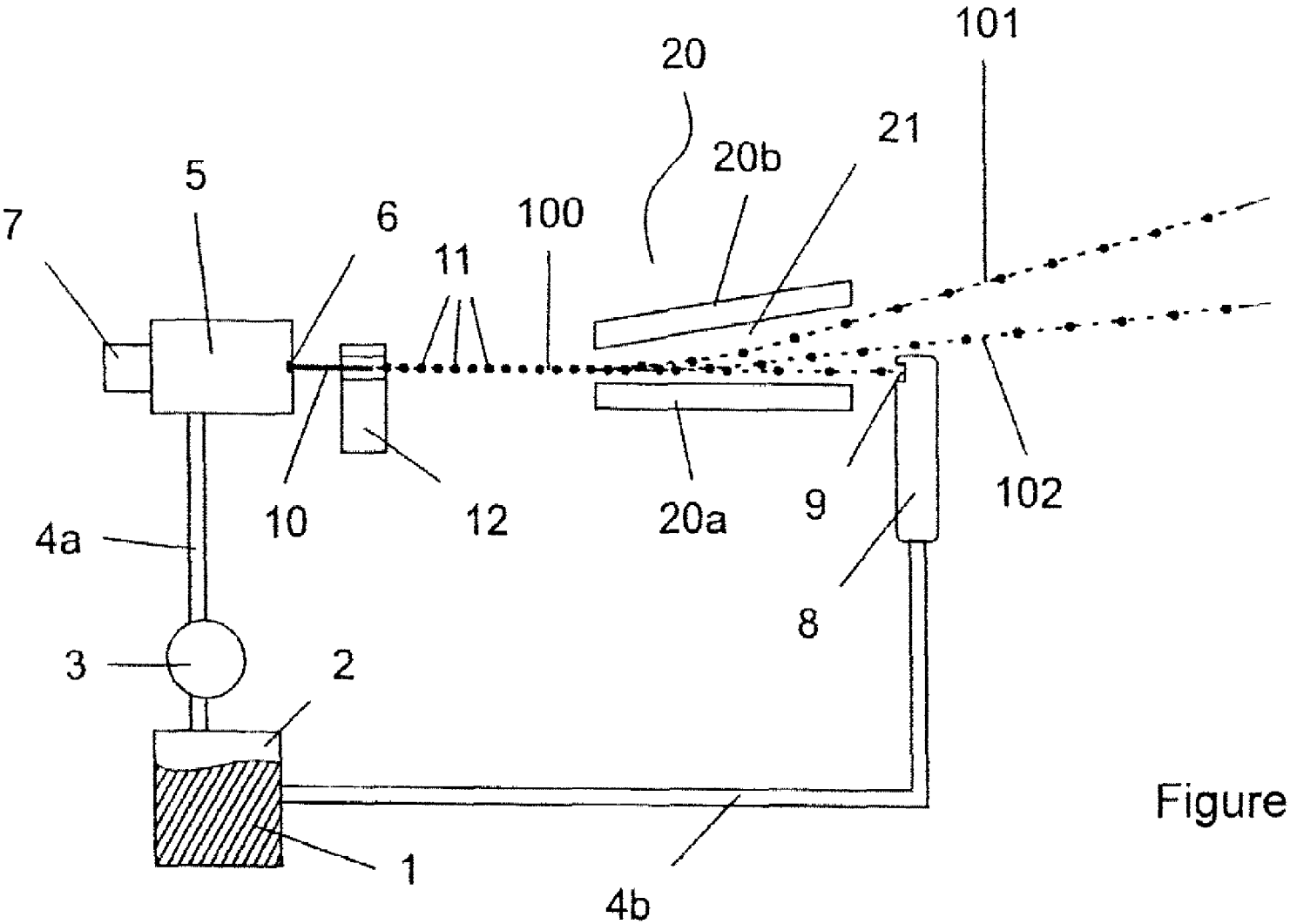
FIG. 1: shows the prior art.

FIG. 1 shows by way of example a print head of a conventional continuous inkjet printer having a single nozzle. The ink 1 is first pumped via a pump 3 from a supply container 2 through supply lines 4*a* into the pressure chamber 5, at one end of which a nozzle 6 is installed. By means of modulation devices 7 also mounted on the pressure chamber, the pressure in the pressure chamber 5 may be modulated so that the ink jet 10 exiting the nozzle 6 is dispersed into individual ink droplets 11 a short distance after being emitted.

Shortly before the dispersal, the individual ink droplets 11 are provided with an individual electrical charge by means of a charge electrode 12. Along their trajectory 100 the ink droplets 11 then enter an electrical field 21 which is formed by the electrodes 20*a* and 20*b* of the plate capacitor 20, which in the sense of the invention forms a deflecting device.

Depending on the amount of charge and the polarity of the charges on the ink droplets 11, as well as the polarity and intensity of the electrical field 21 in the field space of the plate capacitor 20, the individual ink droplets are deflected in different spatial directions 101, 102 illustrated as an example. The total number of possible angles of deflection depends solely on the control by the charge electrode, and in principle is unlimited. The individual plates 20*a* and 20*b* of the plate capacitor 20 may be inclined with respect to one another, as shown in FIG. 1. However, without restricting the universal applicability of the invention it is also possible to use plates situated in parallel.

After leaving the field space 21 of the plate capacitor 20, an electrostatic force no longer acts on the ink droplets 11, and these maintain their new trajectories 101, 102. This results in a fan-shaped set of trajectories; i.e., the airborne ink droplets exhibit divergence.

Ink droplets 11 that have not been charged because they must be excluded from the typeface do not undergo deflection in the electrostatic field 21 of the plate capacitor 20, and pass into an opening 9 in a collection tube 8 for ink return. The ink thus collected is conducted via supply lines 4*b* back to the ink container 2, and are thereby reintroduced into the ink circuit.

Figure 2:
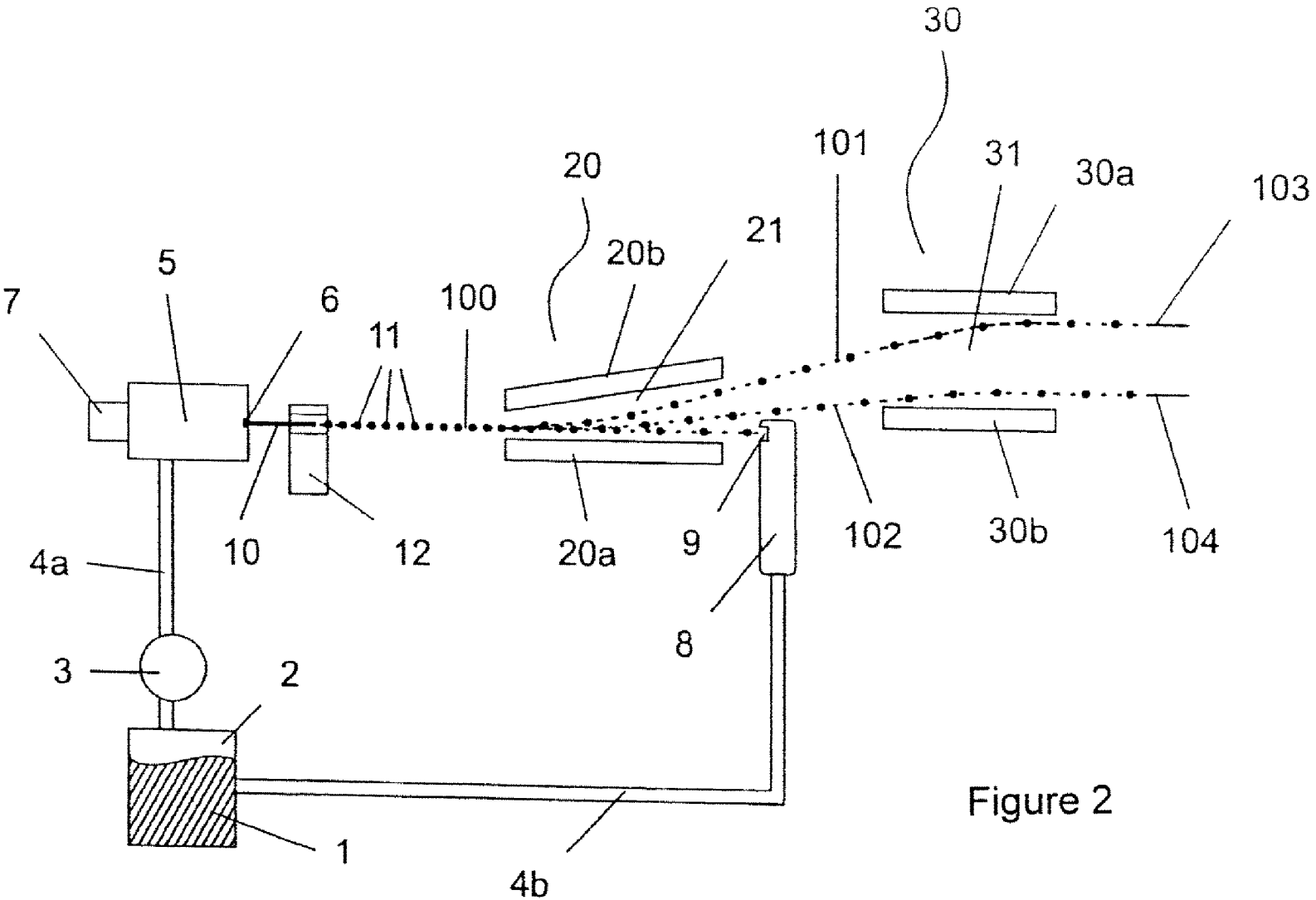
FIG. 2: shows an embodiment having plate capacitors.

As illustrated in FIG. 2, according to the invention an additional plate capacitor 30 is provided downstream from the conventional design described above. This plate capacitor forms a second deflecting device in the sense of the invention.

The purpose of this plate capacitor 30 is to deflect the charged ink droplets 11, which travel into the electrostatic field 31 at a specified angle, from their trajectories 101, 102 in such a way that the resulting trajectories 103, 104 after exiting the electrostatic field 31 of the plate capacitor 30 run essentially in parallel. To this end, the electrostatic field 31 of the plate capacitor 30 has a reverse polarity compared to the electrostatic field of the plate capacitor 20, and the field intensity of field 31 is selected so that the deflection from the original course direction 100 imposed by the electrical field of the first plate capacitor 20 is compensated for, thereby deflecting the charged ink droplets 11 in a course direction 103, 104 which is essentially parallel to the original course direction 100. Without restricting the universal applicability of the invention, it is also possible to incline the plates 30*a* and 30*b* of the plate capacitor 30 with respect to one another.

Figure 3:
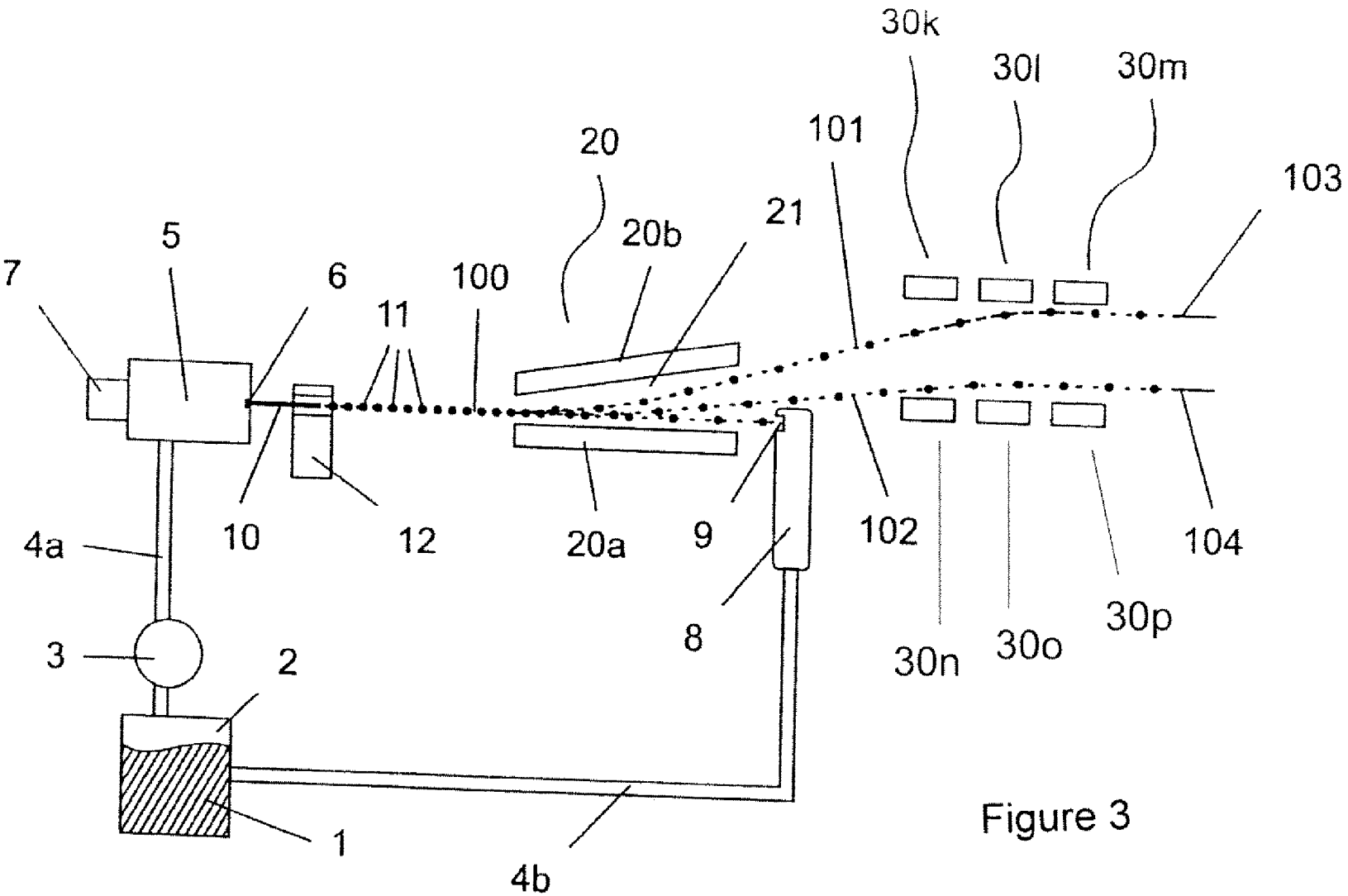
FIG. 3: shows an embodiment the second deflecting device comprising multiple plate capacitors.

In a further example embodiment according to the invention as schematically shown in FIG. 3, the plate capacitor 30 of FIG. 2 may include multiple plate capacitors 30*k*, 301, 30*m*, 30*n*, 30*o*, and 30*p* for example which may be independently controlled in order to optimize the trajectories of the ink droplets as the result of different field intensities within the field spaces of the individual plate capacitors 30*k*, 301, 30*m*, 30*n*, 30*o*, and 30*p* for example.

Not illustrated is the possibility of aligning the trajectories 103, 104 of the ink droplets in parallel downstream from the second deflecting device or plate capacitor(s), for example, 30*k*, 301, 30*m*, 30*n*, 30*o*, and 30*p* in FIG. 3, but at an angle with respect to the original trajectory 100.

The invention claimed is:

1. A method for changing the trajectory of ink droplets generated by and emitted from a print head which operates in a continuous manner, comprising:

charging the ink droplets electrostatically, deflecting the ink droplets in a plane out of an original trajectory by at least one electrical field in a first deflecting device, deflecting the ink droplets in the same plane by at least one electrical field in at least one second deflecting device; and wherein the at least one deflecting device is configured with at least one deflecting member that includes at least one plate capacitor and the trajectories of the ink droplets pass through the field space of the at least one plate capacitor.

2. The method according to claim 1, further comprising:

deflecting the ink droplets in at least one second deflecting device in a direction opposite to the direction of the first deflection in the first deflecting device in such a way that the first deflection is compensated for at least partially.

3. The method according to claim 1 further comprising:

deflecting the ink droplets by the at least one second deflecting device in such a way that the trajectories of all ink droplets run in parallel at an angle with respect to the original trajectory.

4. An inkjet printing apparatus for emitting, in a continuous manner, electrostatically charged ink droplets in an original trajectory comprising:

a first deflecting member configured to deflect the charged ink droplets in a plane out of an original trajectory, and at least one second deflecting member whereby the ink droplets may be deflected in the same plane wherein a deflecting member includes at least one plate capacitor and the trajectories of the ink droplets pass through the field space of the at least one plate capacitor.

5. An inkjet printing apparatus according to claim 4, wherein the at least one second deflecting member is configured to cause a deflection in the direction opposite that of the first deflecting device whereby the deflection by the first deflecting device is at least partially compensated for.

6. An inkjet printing apparatus according to claim 4 wherein the at least one second deflecting member is configured to parallelize the trajectories of the ink droplets in such a way that the trajectories subsequent to a second deflecting device are parallel to the original trajectory.

7. An inkjet printing apparatus according to claim 4 wherein the deflecting members are electrode systems, wherein the electrode systems of the first deflecting device and at least one second deflecting device have different polarities.

8. An inkjet printing apparatus according to claim 4, wherein a deflecting member includes multiple plate capacitors consecutively positioned in the course of the direction of the ink droplets.

9. An inkjet printing apparatus according to claim 4 wherein the at least one second deflecting member is configured to parallelize the trajectories of the ink droplets in such a way that the trajectories subsequent to a second deflecting device are at an angle with respect to the original trajectory.

* * * * *

UNITED STATES PATENT AND TRADEMARK OFFICE

CERTIFICATE OF CORRECTION

PATENT NO. : 7,393,086 B2
APPLICATION NO. : 11/550870
DATED : July 1, 2008
INVENTOR(S) : Frank Otte et al.

It is certified that error appears in the above-identified patent and that said Letters Patent is hereby corrected as shown below:

Title page, item (56), OTHER PUBLICATIONS, please change "German Search Report, Apr. 2, 2007" to -- German Search Report, June 12, 2006 --

Signed and Sealed this

Fourteenth Day of October, 2008

JON W. DUDAS
*Director of the United States Patent and Trademark Office*